United States Patent [19]

Mazie

[11] Patent Number: 4,802,701

[45] Date of Patent: Feb. 7, 1989

[54] ANCHOR LATCH

[76] Inventor: George S. Mazie, 12521 Fordline, Southgate, Mich. 48195

[21] Appl. No.: 948,108

[22] Filed: Dec. 31, 1986

[51] Int. Cl.[4] ..... E05C 21/00

[52] U.S. Cl. ..... 292/340; 292/346

[58] Field of Search ..... 292/340, 346; 70/418, 70/416; D8/344, 343

[56] References Cited

U.S. PATENT DOCUMENTS

| | | | |
|---|---|---|---|
| Re. 31,276 | 6/1983 | Schlage | 292/340 |
| D 34,243 | 3/1901 | Taylor | D8/344 |
| 1,275,938 | 8/1918 | Juselius | 292/346 |
| 1,618,846 | 2/1927 | Rippien | 292/346 |
| 1,919,739 | 7/1933 | Minzenmayer | 292/346 |
| 2,127,891 | 8/1938 | Starling | 292/346 |
| 2,454,904 | 11/1948 | Wylie | 292/346 |
| 2,484,024 | 10/1949 | Garberding | 292/346 |
| 2,568,983 | 9/1951 | Best | 292/340 |
| 2,947,560 | 8/1960 | Klets | 292/251.5 |
| 3,095,021 | 7/1963 | Schlage | 292/340 |
| 3,290,081 | 12/1966 | Sushan | 70/418 |
| 3,392,999 | 7/1968 | Thompson | 292/346 |
| 3,606,429 | 7/1971 | Palmer | 70/418 |
| 3,888,530 | 6/1975 | Fabrici | 292/340 |
| 3,963,269 | 6/1976 | Rosenberg | 292/346 |
| 4,005,890 | 2/1977 | Murch | 292/340 |
| 4,057,275 | 11/1977 | LaBeaud | 292/340 |
| 4,171,836 | 10/1979 | St. Aubin | 292/341.18 |
| 4,174,862 | 11/1979 | Shane | 292/340 |
| 4,195,870 | 4/1980 | Percolo | 292/340 |
| 4,279,436 | 7/1981 | Heffel | 292/346 |
| 4,295,299 | 10/1981 | Nelson | 292/346 |
| 4,369,994 | 1/1983 | Vorves | 292/340 |
| 4,415,191 | 11/1983 | Thorp | 292/346 |
| 4,416,087 | 11/1983 | Ghatak | 292/346 |
| 4,458,931 | 7/1984 | McBurnie | 792/346 |
| 4,474,394 | 10/1984 | Crepinsek | 292/340 |
| 4,531,633 | 7/1985 | Evans | 292/346 |
| 4,547,009 | 10/1985 | Allen | 292/340 |
| 4,684,160 | 8/1987 | Nelson | 292/340 |
| 4,690,445 | 9/1987 | Hartley | 292/346 |

FOREIGN PATENT DOCUMENTS

| | | | |
|---|---|---|---|
| 78704 | 1/1955 | Denmark | 292/340 |
| 396660 | 8/1933 | United Kingdom | 292/346 |

*Primary Examiner*—Gary L. Smith
*Assistant Examiner*—Eric K. Nicholson
*Attorney, Agent, or Firm*—Charles W. Chandler

[57] ABSTRACT

An improved latch plate in combination with an anchor base plate designed to resist forceable entry when disposed within a doorjamb. The construction of said latch may be adapted to engage either a sliding bolt or dead bolt when disposed over the bolt recess of a doorjamb. The latch has a flat plate portion with a large opening to receive a bolt, the flat plate has anchor corner and lip end, with an anchor stem extending inwardly towards the doorjamb and perpendicularly from the inside of the flat plate at the anchor corner. The anchor stem is in bearing contact within the doorjamb recess of the door frame and protrudes through a longitudinal aperture located in the anchor base plate into the doorjamb frame. The anchor base has a plurality of apertures disposed on both sides of the longitudinal aperture and are so located to cooperately receive the screws from the latch plate. The location of the plurality of apertures disposed on the anchor base plate is such so as not to cause a splitting of the wood frame into which they are screwed due to their offset. Traverse to the plurality of screws of the anchor base plate are a pair of safety screws disposed into the doorjamb through apertures located in anchor stem of the latch plate. Both the anchor stem of the lock strike plate and anchor base plate are concealed from view when mounted on the doorjamb. A tab extends into the doorjamb framing from the large opening disposed on the flat portion of the latch to further increase the strength of the assembly against unauthorized or foreceable entry by means of kicking and/or pushing against the door. Thus providing the occupant of a dwelling with improved security as compared with conventional lock strike plates.

8 Claims, 1 Drawing Sheet

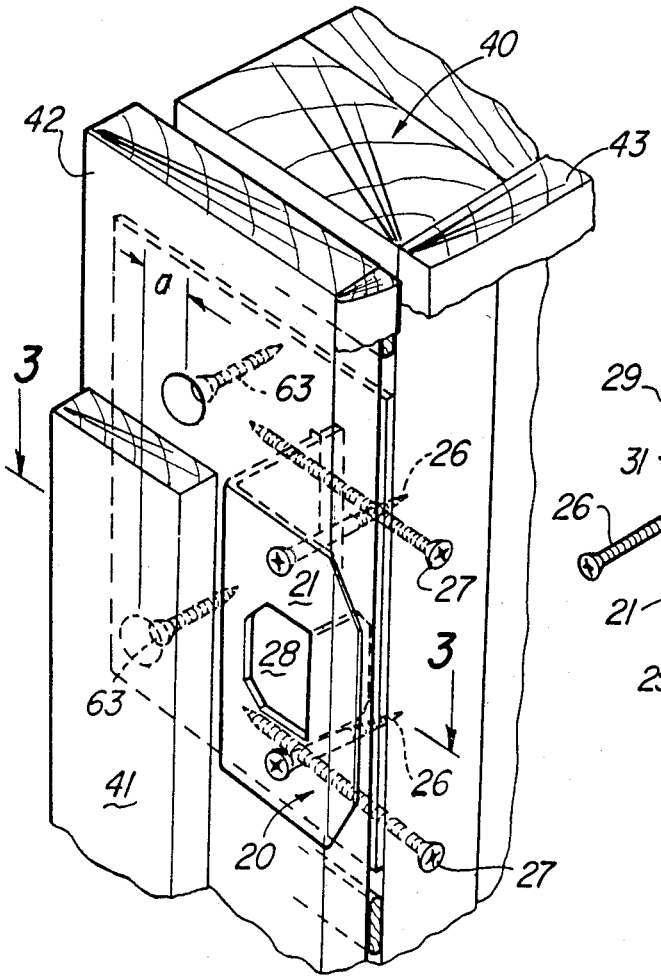
Fig-1
Fig-2
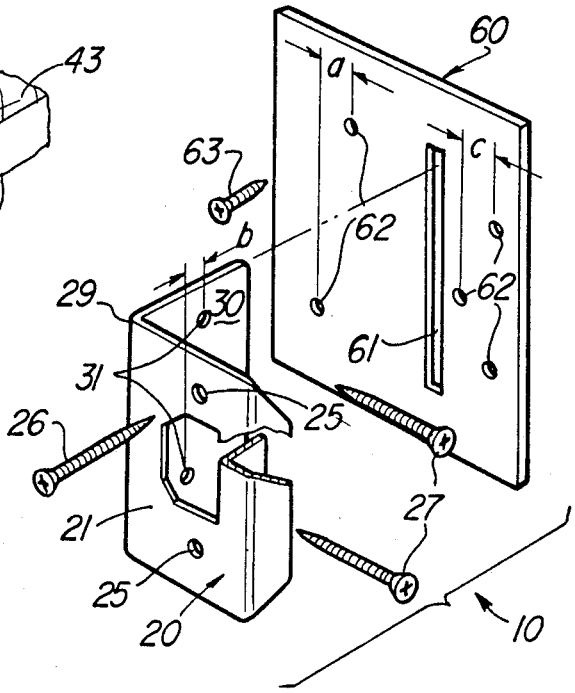
Fig-4
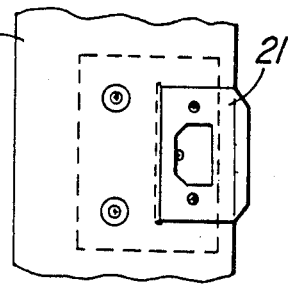
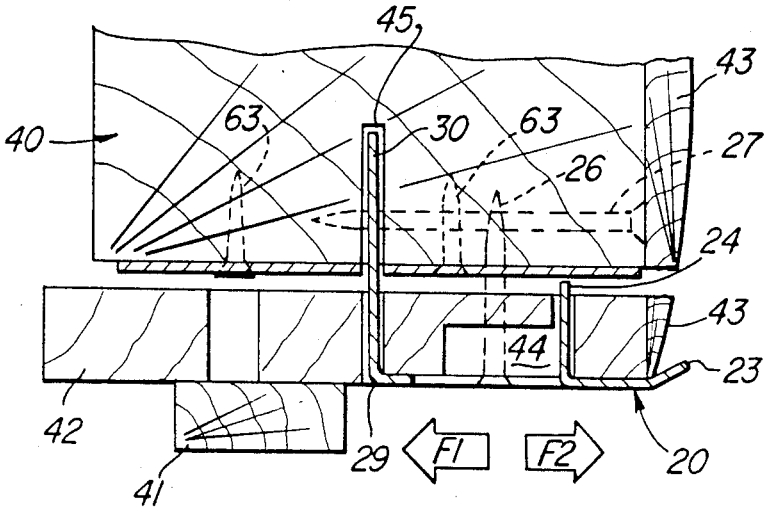
Fig-3
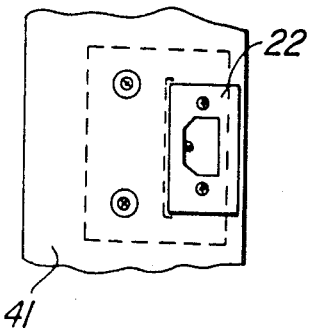
Fig-5

ANCHOR LATCH

BACKGROUND OF THE INVENTION

1. Field of the Invention

This invention relates to a new and useful improved door latch assembly consisting of a latch plate and anchor base plate combination which is capable of resisting unauthorized forceable entry of a dwelling by means of kicking and/or pushing against the door. The ineffectiveness of the prior art latch plates to resist forceable entry to any reasonable degree has been a long standing serious and widely recognized prior art problem.

2. Brief Description of the Prior Art

While the prior art is replete with security devices designed to solve the unauthorized entry by use of a thin knife blade or plastic card being inserted between the door edge and the doorjamb to cause the displacement of a conventional sliding bolt lock system, none of the prior art has solved the problem of a weak latch plate being forcefully displaced by means of a kick and/or push against the door. Thus, the weakest part of the door lock assembly has been the lock latch plate itself, therefore, devices designed to solve the problem of prohibiting the displacement of the sliding bolt has failed to solve the problem associated with the weak anchorage of the door latch plate by use of only a plurality of conventional screws.

In an attempt to solve the prior art problem of weak anchorage of the door latch plate a device issued under U.S. Pat. No. 4,189,175 to Paxton was invented. The Paxton device consists of an improved door strike assembly having a cylindrical tang adapted for deep insertion within the door jamb. While Paxton's device admittedly strengthens the anchorage of the lock strike plate, it was done with a rather large, expensive, and complicated type of construction. In comparison to the Paxton solution, the present invention successfully strengthens and reinforces the lock strike plate with a conventional type design which is small, inexpensive, and uncomplicated to install.

Another example of a patented prior art is disclosed in U.S. Pat. No. 3,967,845 to Governale. The Governale device consists of a metal reinforcing plate in combination with a conventional strike plate. The reinforcing plate has integral anchor prongs which are driven into the wood jamb, thus effectively strengthening the lock strike plate. However, my invention is much improved over the Governale device due to its novel construction utilizing an anchor stem for the full length of the lock strike plate; said anchor stem being in a frictional contact with the doorjamb when disposed into a routed recess contained therein and eliminates the necessity of using a metal reinforcing plate in addition to the improved strike plate.

Another example of a prior art patent which failed to solve the problem of a weak latch plate was U.S. Pat. No. 4,171,837 to McRoy. The McRoy device has a vertically elongate locking plate with a T-shaped cross section adapted to be secured to the doorjamb adjacent the door crevice, but does not teach nor suggest my combination of a latch plate and anchor base plate which are cooperatively assembled so as to provide a rigid mounting that cannot be dislodged by kicking, pushing or use of a burglary tool.

The last prior art reference which applicant wishes to bring to the Examiner's attention in U.S. Pat. No. Des. 283,299 issued to applicant for an ornamental design for a door lock brace latch which was issued on Apr. 8, 1986 and is concerned only with the ornamental design of a door lock brace latch and is not concerned with the functional aspects of a lock latch plate and anchor base plate combination.

BRIEF DESCRIPTION OF THE INVENTION

The present invention provides a simple and effective door latch assembly.

Accordingly, one object of the present invention is to provide an improved door latch assembly for preventing unauthorized entry through a locked door.

Another object of the present invention is to provide a pry proof latch plate and anchor base plate combination which is simple in design, economical to manufacture, rugged in construction, easy to use, and efficient in operation.

Another object of the present invention is to provide an improved latch plate and anchor base plate combination capable of being installed on any existing doorjamb without the necessity of changing either the door or the doorjamb.

Still another object of the present invention is to provide a latch plate and anchor base plate combination usable with existing door lock hardware.

Still another object of the present invention is to provide a latch plate and anchor base plate combination having an anchor stem which is disposed within a routed recess within the doorjamb.

Still another object of the present invention is to provide an effective impediment to resist forceable entry by means of kicking and/or pushing against a door which causes the disengagement of the latch plate from the doorjamb.

Still further another object of the present invention is to provide a door latch assembly which utilizes either or in combination a latch plate for a spring or dead bolt type lock assembly.

To accomplish the foregoing and other objects of this invention there is provided an improved latch plate having an anchor stem extending outwardly and perpendicularly from the inside straight end of said latch plate through a longitudinal aperture disposed on the anchor base plate into a routed recess within the doorjamb. Thus, effectively anchoring of said latch plate via the frictional contact developed between the anchor stem and doorjamb.

BRIEF DESCRIPTION OF THE DRAWINGS

The invention is illustrated in the accompanying drawings, wherein:

FIG. 1 is a perspective view partially in phantom lines of a door latch assembly installed on a doorjamb having a doorstop.

FIG. 2 an exploded perspective view of a door latch assembly showing the latch plate and anchor base plate without the doorjamb or doorstop.

FIG. 3 is a sectional view taken in the direction of the arrows on section line 3—3 of FIG. 1.

FIG. 4 is a front elevational view of a door latch assembly utilizing a latch strike plate used with a spring bolt lock type assembly.

FIG. 5 is a front elevational view of a door latch assembly utilizing a latch bolt plate used with a dead bolt lock type assembly.

It is to be understood that the present invention is not limited in its application to the details of construction and arrangement of parts illustrated in the accompanying drawings, since the invention is capable of other embodiments and of being practiced or carried out in various ways within the scope of the claims. Also, it is to be understood that the phraseology and terminology employed herein is for the purpose of description and not of limitation.

DESCRIPTION OF THE PREFERRED EMBODIMENT

As my preferred embodiment I have shown in FIG. 1 of the drawings my improved door latch assembly 10 mounted on a doorjamb 40 having a doorstop 41, face plate 42 and trim moulding 43.

My improved door latch assembly 10 as can be best seen in FIGS. 1 to 4 comprises a latch plate 20 and more particularly a strike latch plate 21, mounted on a doorjamb 40 by means of latch screws 26 disposed through latch apertures 25. The strike latch plate 21 is provided with opening 28, which coincides with doorjamb 40, recess 44 for receiving either a sliding or dead bolt (not shown). Perpendicular to the strike latch plate 21 at one side of the opening 28 is tab 24 disposed within the recess 44 portion of doorjamb 40. The tab 24 extends into the doorjamb 40 framing from the large opening 28 of the strike latch plate 21 to further increase the strength of the assembly against unauthorized or forceable entry by means of kicking and/or pushing against the door.

Located at the anchor corner 29 of strike latch plate 21 is anchor stem 30, which extends perpendicularly away from anchor corner 29; said anchor stem 30 being disposed within the doorjamb recess 45 located within doorjamb 40. The opposite end of latch plate 21 is so designed to have an inwardly curved flange 23 so as to function as a strike latch plate 21. The anchor stem 30 is in a bearing contact with the doorjamb recess 45 of the doorjamb 40 and protrudes through a longitudinal aperture 61 located in the anchor base plate 60. Once the strike latch plate 21 is properly installed on the doorjamb 40 it is secured in place by means of a plurality of safety screws 27 disposed through stem apertures 31 and a plurality of latch screws 26 disposed through latch apertures 25 into doorjamb 40. The stem apertures 31 are so positioned in relation to each other so as to be horizontally offset by an amount "b" as can be seen in FIG. 2 of the drawings, which prevents or reduces the splitting of the wood doorjamb.

Referring to FIG. 2 of the drawings an anchor base plate 60 is shown in a exploded perspective view of a door latch assembly 10 showing a strike latch plate relationship to the assembly. The anchor base plate 60 has a longitudinal aperture 61 which cooperatively accepts the anchor stem 30 of the strike latch plate 21. The anchor base plate 60 has a plurality of base apertures 62 designed to accommodate latch screws 26 and base screws 63 which together securely hold in place anchor base plate 60 to doorjamb 40. The base apertures 62 are so positioned in relation to each other so as to have a horizontal offset "a" and "c" which prevents the longitudinal splitting of the doorjamb 40 when a strong force is applied to the door latch assembly 10 during a foreceful entry attempt. While two of the base apertures 62 are so designed as to cooperatively accept the latch screws 26.

Referring to FIG. 3 of the drawings it can be readily appreciated that an application of a horizontal Force 1 or 2 caused by either a sliding or dead bolt (not shown) during an attempted forced entry will be substantially resisted by the door latch assembly 10 disposed within the recess 44 and doorjamb recess 45. It can further be appreciated that the use of my improved door latch assembly 10 in lieu of the conventional type of striker plates greatly reduces the chance of forceable entry by means of kicking and/or pushing against the door. Further, the use of a flat object inserted between the doorstop 41, and doorjamb 40 to pry the strike latch plate 21 away from the doorjamb 40 will also be effectively prevented; thus giving the occupant of a dwelling more time to obtain help should an unauthorized intrusion occur during their presence. It should be also apparent that my invention is capable of being easily installed on any new or existing doorjamb.

The first step of installation in an existing doorjamb would be to remove the existing lock strike plate trim molding 43, doorstop 41 and face plate 42. Next, both recess 44 and doorjamb recess 45 would be routed so as to accommodate the anchor stem 30 and tab 24 of the strike latch plate 21, without the necessity of modification of either the door lock or the doorjamb. Once the doorjamb recess 45 is routed within the doorjamb 40 the anchor base plate 60 is secured in place by means of base screws 63 into the doorjamb 40 through base apertures 62.

Once the anchor base plate 60 is affixed to doorjamb 40 the face plate 42 with doorstop 41 is placed over the anchor base plate 60 and the strike latch plate 21 is permanently installed by means of latch screws 26 which extend through latch apertures 25 and base apertures 62 into the doorjamb 40. Traverse to the direction of the latch screws 26 are safety screws 27 which are installed from the trim molding 43 side of the doorjamb 40, through stem apertures 31 into the doorjamb 40. The stem aperture are so designed so as to have an offset "b" which reduce the possibility of the wood splitting when Force 1 & 2 are applied. Once the safety screws 27 are installed the trim molding 43 is replaced on the doorjamb 40.

While I have described the installation steps include the removal of both the doorstop 41 and face plate 42 it is possible to install the anchor base plate 60 by simply forcing it between the doorjamb 40 and the face plate 42 once the trim molding 43 is removed. Then the routing recess 44 and doorjamb recess 45 can be drilled using an alinement template (not shown) to insure the accurate drilling of the apertures 46 required to accommodate base screws 63 and latch screws 26, as can be best seen in FIG. 1 of the drawings.

I wish also to disclose as an alternate embodiment to my door latch assembly 10 the use of a dead bolt latch plate 22, as can be best seen in FIG. 5 of the drawings. The use of this type of latch plate 20 will accommodate the use of a dead bolt locking system in lieu of the spring type. It is also possible that both a sliding (spring) or dead bolt locking system can be used on the same door and my door latch assembly 10 could be easily adaptable to both.

While my door latch assembly 10 may be constructed from most any of the known materials used for door latches, I wish to disclose the use of harden steel type material with either a brass plate or stainless steel finish.

I have disclosed a novel construction of an improved door latch assembly which is simple in design, economical to manufacture, rugged in construction and easily installed on any existing door having either a sliding or dead bolt lock hardware.

Thus, by abandoning the previous construction of conventional type door latches, I have invented an improved heavy duty door latch assembly which is simple, practical, economical and attractive in appearance and solves the problem of the latch plate being the weakest part of a door lock assembly.

I claim:

1. A security latch comprising:

a wooden door frame structure having a vertical first wooden member and a vertical second wooden member, the first wooden member having spaced parallel first and second surfaces, the first wooden member being disposed in a side-by-side relationship with the second wooden member;

a latch plate having a planar outer section with a bolt-receiving opening for receiving a locking door bolt, and means for fastening said latch plate to the first wooden member in abutment with the first surface thereof, the latch plate having a planar anchor section disposed at a right angle to said outer section, the anchor section having a width greater than the thickness of the first wooden member so as to extend beyond the second surface thereof, whereby the outer section of the latch plate is disposed adjacent the first surface thereof, the anchor section having a fastener-receiving opening therein;

a planar base plate having an opening for receiving the anchor section of the latch plate, the base plate being disposed between member and the second wooden member in a spaced, parallel relationship to the outer section of the latch plate such that a portion of the fist wooden member is sandwiched between the outer section of the latch plate and the base plate, and the fastener-receiving opening in the anchor section is disposed on the opposite side of the base plate as the outer section of the latch plate; and an elongated screw received in the second wooden member through the fastener-receiving opening in the anchor section, the screw being disposed on the opposite side of the base plate as the outer section of the latch plate.

2. A combination as defined in claim 1, including a second screw for connecting the base plate to the second wooden member.

3. A combination as defined in claim 1, in which the latch plate has an integral tab perpendicular to the outer section of the latch plate and defining one side of said bolt-receiving opening.

4. A door latch assembly as defined in claim 1, wherein said latch plate and anchor base plate are made from a harden steel material having a stainless steel finish.

5. A door latch assembly as defined in claim 1, wherein said latch plate and anchor base plate are made from a harden steel material having a brass finish.

6. A door latch assembly as defined in claim 1, wherein said latch plate has an inwardly curved flange on its opposite side from the anchor stem.

7. A door latch assembly as defined in claim 6, wherein the anchor section extends perpendicularly away from the anchor corner of said latch plate, being disposed within a doorjamb recess located within a doorjamb.

8. A door latch assembly as defined in calim 1, wherein the means for securing said latch plate and base plate to the doorjamb consists of a plurality of screws.

* * * * *